United States Patent [19]

Wolf

[11] Patent Number: 4,739,138

[45] Date of Patent: Apr. 19, 1988

[54] ROTARY ELECTRICAL SWITCH

[75] Inventor: Jürgen Wolf, Kriftel, Fed. Rep. of Germany

[73] Assignee: Braun Aktiengesellschaft, Kronberg, Fed. Rep. of Germany

[21] Appl. No.: 923,880

[22] Filed: Oct. 28, 1986

[30] Foreign Application Priority Data

Oct. 30, 1985 [DE] Fed. Rep. of Germany ..... 3538546

[51] Int. Cl.[4] ..... H01H 19/00; H01H 9/20; H01H 21/62

[52] U.S. Cl. ..... 200/155 R; 200/292; 200/291; 200/11 DA; 200/11 G; 200/325

[58] Field of Search ..... 200/292, 291, 295, 296, 200/336, 155 R, 257, 11 R, 11 D, 11 DA, 11 G, 11 TW, 321, 318, 323–325; 74/527

[56] References Cited

U.S. PATENT DOCUMENTS

| | | | |
|---|---|---|---|
| 2,025,831 | 12/1935 | Schellenger | 200/11 G |
| 2,847,523 | 8/1958 | Van Amelsfort | 200/11 G |
| 2,896,033 | 7/1959 | Hartz | 200/11 DA |
| 3,511,956 | 5/1970 | Fields | 200/336 |
| 3,518,389 | 6/1970 | Doering, Jr. et al. | 200/11 DA |
| 3,592,983 | 7/1971 | Kroll et al. | 200/16 R |
| 3,594,527 | 7/1971 | Brant | 200/11 G |
| 3,944,761 | 3/1976 | Nicholl et al. | 200/291 X |
| 4,032,730 | 6/1977 | Golbeck et al. | 200/11 DA |
| 4,038,504 | 7/1977 | McAnulty et al. | 200/11 DA |
| 4,196,324 | 4/1980 | Kojima et al. | 200/11 DA |
| 4,206,334 | 6/1980 | LaRock | 200/291 |
| 4,368,365 | 1/1983 | Jacquet | 200/11 TW |
| 4,392,030 | 7/1983 | Buss | 200/11 R |
| 4,539,444 | 9/1985 | Senoh | 200/292 |
| 4,551,587 | 11/1985 | Rose | 200/11 R |

FOREIGN PATENT DOCUMENTS

| | | | |
|---|---|---|---|
| 1189390 | 7/1960 | Fed. Rep. of Germany . | |
| 1111703 | 7/1961 | Fed. Rep. of Germany . | |
| 2036775 | 6/1972 | Fed. Rep. of Germany . | |
| 8402973 | 7/1984 | Fed. Rep. of Germany . | |
| 3225694 | 2/1985 | Fed. Rep. of Germany . | |
| 2026242 | 1/1980 | United Kingdom | 200/11 TW |
| 2027276 | 2/1980 | United Kingdom | 200/11 R |

*Primary Examiner*—Henry J. Recla
*Assistant Examiner*—Ernest G. Cusick

[57] ABSTRACT

The rotary electrical switch 1 which is mounted on a circuit plate 7 furnished with a printed circuit comprises a switch wheel 4 which is rotatably supported on the circuit plate 7 and whereat a contact bridge 48 is inserted into a pocket 46. On rotation of the rotary switch 1, said contact bridge 48 connects and/or disconnects at least two conducting paths of the printed circuit. Shaped at the switch wheel 4 is a pivot pin 17 which penetrates the circuit plate 7 and which is secured by a base member 5 to the circuit plate 7 on the said's bottom side opposite to the printed circuit. The switch wheel 4 includes catch-type recesses 42, with a resilient switching element 32 engaging into each one recess depending on the position of rotation of the switch wheel 4. The base member 5 urges via the switch wheel 4 the contact lugs 48 resiliently against the circuit plate 7, additionally forms the catch-type element 40 and simultaneously couples the switch wheel 4 and the circuit plate 7.

18 Claims, 1 Drawing Sheet

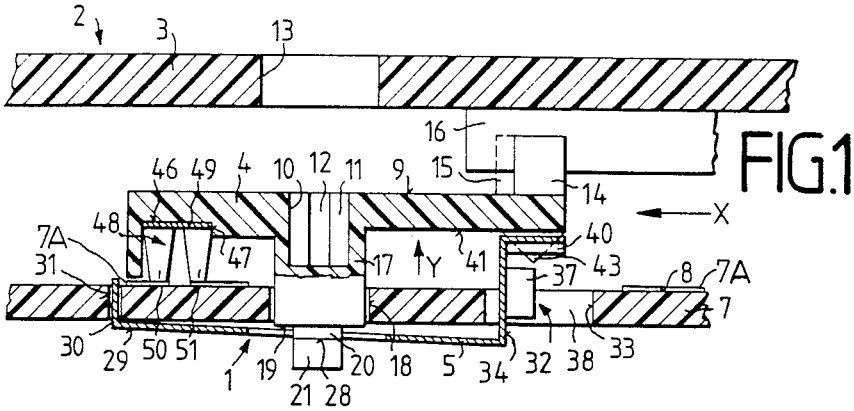
FIG.1
FIG.2
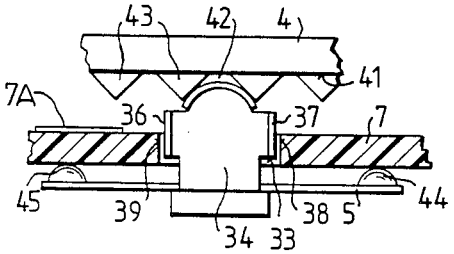
FIG.3
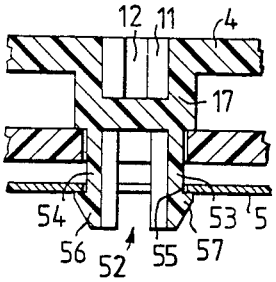
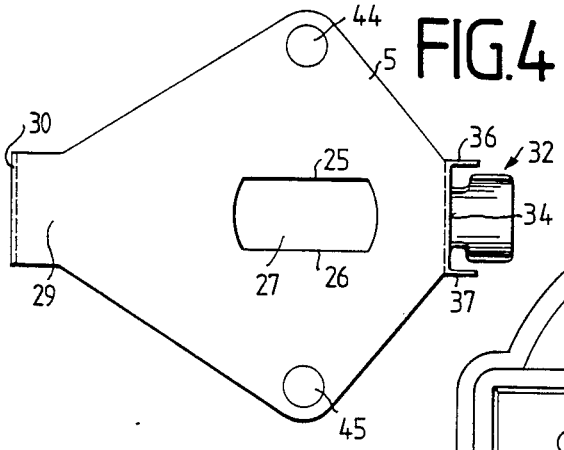
FIG.4
FIG.5
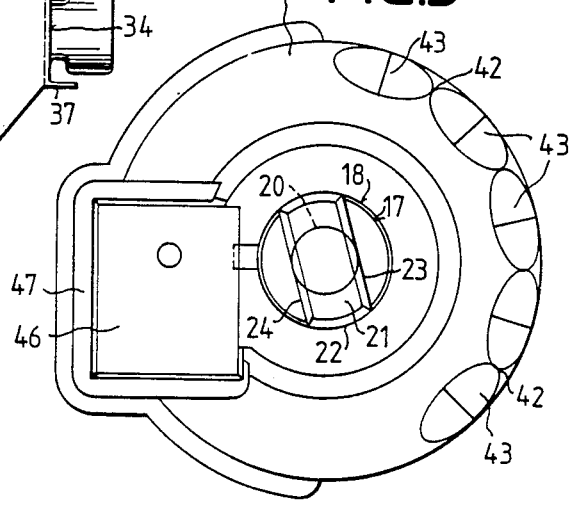

ROTARY ELECTRICAL SWITCH

The present invention relates to a rotary electrical switch which is mounted on a circuit plate provided with a printed circuit, with a switch wheel rotatably supported on the circuit plate, with at least one contact bridge which, on rotary movement of the rotary switch, interconnects at least two conducting paths of the printed circuit, with a pivot pin extending from the switch wheel and penetrating the circuit plate, the said pivot pin being adapted to be secured by a fastening element to the circuit plate on the bottom side thereof opposite to the printed circuit, with a spring element resiliently pressing the contact bridge against the circuit plate, and with catch-type recesses designed at the rotary switch, into which at least one resilient switching element engages depending on the position of the rotation of the switch wheel.

BACKGROUND OF THE INVENTION

A like rotary electrical switch is known from German examined patent application No. 20 36 775. It is composed of a rotary button, two contact bridges, a circuit plate, a compression spring and a disc. In the assembled condition of the rotary switch, the spring draws the pin through the disc downwardly away from the circuit plate so that, as a result, the contact bridges are pressed resiliently against the circuit plate by the rotary button.

It is to be considered less favorable in this rotary switch that, since the hole diameter of the disc is slightly smaller than the external diameter of the pin, relatively great mounting forces are caused during mounting with the end of urging the disc for the purpose of its positive retaining engagement over the pin into the groove therefor provided. This necessitates special mounting tools which entail higher costs. Apart from the increased mounting efforts needed, likewise the spring representing a special piece part has adverse effects on the costs for the rotary switch.

Moreover, the balls designed at the two ends of the contact bridges as well as the bipartite design render the manufacture of the contact bridges costly which, in the embodiment herein illustrated, must be made either as turned pieces or a shaped parts.

What is to be regarded as another shortcoming is the functionability of the rotary switch, wherein on each switch actuation the balls of the contact bridges slide out of the bores furnished in the circuit plate what may cause premature damage to the frequently very thin circuit plate. Likewise the displacement of the rotary button in its axial direction during a switching action is a disadvantage.

Therefore, it is the object of the present invention to devise a rotary electrical switch which is composed of as few components as possible, requires little mounting space and costs, which permits a quick and simple assembly and which, beside its great reliability in operation, affords much ease of handling.

SUMMARY OF THE INVENTION

This object is achieved by the instant invention in that the fastening element, the spring element and the switching element are constituted by one single, elastically deformable base member. The inventive base member secures and guides the switch wheel without clearance on the circuit plate, secures the contact bridges between the switch wheel and the circuit plate and imparts the desired lock function to the switch wheel. The rotary switch lends itself to being easily mounted by hand, without there being the need for additional tools. On actuation of the rotary switch, the circuit plate remains uninfluenced by switching forces.

A particularly simple assembly of the rotary switch is attained in that the base member is designed on the bottom side of the circuit plate and in that the base member is coupled to the free end of the pin by positive engagement, preferably by virtue of a bayonet-type lock or a snap-in engagement. This simple type of connection permits to easily replace the rotary switch without necessitating simultaneous replacement of the circuit plate.

The catch-type effect at the rotary switch can be realized by the present invention in a particularly straightforward manner in that, at the edge of the base member, a tab angled off towards the base member is shaped which penetrates an opening in the circuit plate and which resiliently engages witch its free end into one of the recesses, the said recesses being formed at the bottom side of the switch wheel disposed opposite to the printed circuit of the circuit plate. The resilient tab acting on the switch wheel, on the one hand, guards the base member against torsion and causes the switch wheel during the rotary movement of the rotary switch to always assume an exactly predefined lock position. This permits the switch wheel to turn completely without play and to catch the switching position desired almost automaticlly, without the need to re-adjust by hand. It has proved to be particularly advantageous in this arrangement that the recesses have substantially a V-shaped configuration, that the tab extending away from the base member is of substantially L-shaped design in cross-section, and that the leg extending rectangularly from the longer leg of the tab is curved towards the switch wheel such as to engage into each recess of the switch wheel without play.

To the end that the contact lugs are urged against the circuit plate sufficiently strongly by the switch wheel and, simultaneously, the rotary force required by the switch wheel for passing by the catch-type elements is kept within acceptable limits, it is arranged for in an improvement of this invention that the length of the portion of the tab penetrating the circuit plate vertically is sized such as to bias the base member between the recesses and its attachment to the pin. Hence follows that the resilient force of the base member can be determined by its thickness, the material it is made of and by its geometrical dimensions, the last-mentioned feature permitting the base member to attain the characteristics of a particularly weak spring due to the great spatial freedom.

In order to ensure anti-torsion retention of the base member on the circuit plate without the aid of the pivot bearing, a sheet-metal lug is shaped on the edge of the base member opposite to the tab, which lug engages into an indentation in the circuit plate.

The bias of the base member in relation to the circuit plate and the pin can still be increased inventively in that the base member includes projections directed to the bottom side of the circuit plate and bearing thereagainst. Consequently, the base member is biased by both the tab and the projections. Caused thereby, among others, the base member is pressed comparatively evenly against the pin, thus achieving also a good distribution of bending stress in the base member. Sufficient resilient forces in specially thin-walled material and affording a long useful life are obtained by the employment of spring steel sheet, the axial overall length of the rotary switch being but slightly increased. The base member can be manufactured particularly low-priced and straightforwardly by die cutting and bending process.

It is provided in an improvement of this invention that the contact bridge is located in a recess designed at the switch wheel, the edge of said recess confining the contact bridge with little clearance, and that in the assembled condition of the rotary switch the circuit plate locks the contact bridge in the recess of the switch wheel to prevent it from falling out. Owing to this arrangement, the need for additional retaining menas for the contact bridge is obviated.

To the end that the switch wheel does not cause any short-circuits on the circuit plate and, simultaneously, lends itself to simple and low-cost manufacture, it is made of plastics.

To prevent the bayonet-type lock from being disengaged after the rotary switch is mounted into a housing, it is provided by the instant invention that two stops limiting the rotary movement of the switch wheel are designed on the upper side of the switch wheel averted from the circuit plate, the said stops being movable into operative engagement with another stop arranged in the housing and coming into mesh with the said two stops. Herein, the housing can be a component part of a coffee machine or any other electrical appliance, for instance.

It is an advantage to have a follower mechanism designed at the upper side of the switch wheel which serves to accommodate and to secure a rotary button and to have said rotary button penetrate the housing to the outside. The bipartite design of rotary button and switch wheel accomplishes that different materials can be chosen to fabricate these parts depending on the function they have to perform and that the housing can be dismounted from the stationary base of the machine after the rotary button has been removed.

BRIEF DESCRIPTION OF THE DRAWING

An embodiment of this invention will be described in more detail hereinbelow with reference to the accompanying drawing.

In the drawing,

FIG. 1 is a longitudinal cross-sectional view of the rotary electrical switch according to this invention, FIG. 2 is a partial cross-sectional side view in the direction of the arrow X according to FIG. 1, FIG. 3 is a partial cross-sectional view of another embodiment of an attachment of the switch wheel to the base member, FIG. 4 is a top view of the base member illustrated as a piece part, and FIG. 5 is a top view of the switch wheel illustrated as a piece part in the direction of the arrow Y according to FIG. 1.

DESCRIPTION OF PARTICULAR EMBODIMENTS

In FIG. 1, the rotary electrical switch 1 is in a housing 2, which e.g. is part of a coffee machine, below a housing wall 3. Said rotary electrical switch 1 consists of a switch wheel 4, a unitary spring metal sheet that includes fastening portion 27, lug portion 30 and indexing portion 32, base member 5 and a contact bridge 48. The switch wheel 4 corresponds to the shape of a circular disc which is displayed in the drawing above a circuit plate 7 and which extends substantially in parallel to said plate. On the surface 8 of the circuit plate 7, there are printed electrically conductive circuit lines, diagrammatically shown in the drawing at 7A, which are connected to at least one control circuitry fastened to the surface 8 of the circuit plate 7. However, this control circuitry is not illustrated in the drawing.

Designed on the upper side 9 of the switch wheel 4 opposite to the housing wall 3 is a blind-end bore 10 which extends concentrically relative to the switch wheel 4 and vertically to the upper side 9 downwardly in the drawing. The blind-end bore 10 contains a radially outwardly extending recess 12 at one of its longer lateral surfaces 11. Said blind-end bore 10 serves to accommodate a pin designed as a rotary button, with neither the pin nor the rotary button being shown in the drawing. Said pin projects upwardly through a bore 13, which latter is in the housing wall 3 and extends concentrically to the blind-end bore 10, out of the housing 2 and is connected to the rotary button actuatable by hand. A catch-type element designed at the pin of the rotary button (but not shown) engages into the recess 12, thereby accurately defining the position of the rotary button relative to the housing 2 and to the rotary switch 1. Shaped at the upper side 9 at the circumferential edge of the switch wheel 4 are two stops 14, 15 which extend upwards in the drawing and which are spaced at a predetermined angle from one another on the same radius from the bore 10. Engaging into the annular space established between the two stops 14, 15 is a stop 16 which is formed at the housing 2 and which extends from the housing wall 3 downwardly in the drawing.

According to FIGS. 1 and 5, a pin 17 extending concentrially to the blind-end bore 10 succeeds the blind-end bore 10 downwards in the drawing, the said pin penetrating a throughbore 18 designed at the circuit plate 7 and being centered in said through-bore 18. At the level of the bottom side of the circuit plate 7, the pin 17 tapers across an annular step 19 in such a manner that an annular groove 20 is formed on the pin 17. The width of said annular groove 20 is not much more than the thickness of the base member 5. Following the annular groove 20 at the pin 17 in the drawing downwards is a section substantially rectangular in cross-section, the largest external diameter 22 of which corresponds to the largest external diameter of the pin 17. The distance between the two lateral surfaces 23, 24 is about as large as the distance between the two lateral surfaces 25, 26 of a fastening portion in the form of bore 27 designed in the base member 5 according to FIG. 4. The cross-section of the bore 27 according to FIG. 4 corresponds to the external dimensions of the section 21 according to FIG. 5, it is but slightly larger than the section 21 in order to allow the section 21 to extend through the bore 27. Thus, the section 21 together with the bore 27 and the base member 5 constitutes the bayonet-type lock of the rotary switch 1. The diameter of the annular groove 20 according to FIG. 1 corresponds almost to the width of the section 21, measured at the shortest length of the two lateral surfaces 23, 24 according to FIG. 5.

Corresponding to FIG. 1, the base member 5 is centered in the annular groove 20 by the two lateral surfaces 25, 26. In the drawing, section 21 is disposed beneath the base member 5 and abuts with its bearing surface 28 against the bottom side 29 of the base member 5.

According to FIG. 4, the base member 5 is of substantially trapezoidal design in topview. At the left end in the drawing, a sheet-metal lug 30 is formed at the base member 5 according to FIGS. 1 and 4, which lug extends vertically upwardly to the base member according to FIG. 1 and which engages into a slot 31 in the circuit plate 7, the said slot being conformed to the sheet-metal lug 30.

According to FIGS. 1 and 4, an indexing portion in the form of a tab 32 of L-shaped cross-section is formed on the side opposite to the sheet-metal lug 30, the said tab penetrating upwardly in the drawing through a bore 33 in the circuit plate 7, said bore being square in cross-section. According to FIGS. 1, 2 and 4, the longer leg 34 is furnished laterally on either side with sheet-metal strips 36,37 rectangular in cross-section and confined by the lateral walls 38, 39 of the bore 33. Said lateral walls 38, 39 serve to prevent the base member 5 from tilting off sideways.

According to FIGS. 1 and 2, a shorter leg 40 which is directed to the right in the drawing according to FIG. 1 succeeds the longer leg 34 at a right angle thereto. This shorter leg 40 forms the footing of the L-shaped tab 32. Leg 40 is curved upwardly according to FIG. 2 and engages into a recess 42 V-shaped in cross-section which is formed at the bottom side 41 of the switch wheel 4. In FIGS. 2 and 5, several prong-shaped shoulders 43 of like size are arranged one behind the other at the radially outer edge of the bottom side 41 of the switch wheel 4, with the recesses 42 disposed intermediate said shoulders. On actuation of the rotary switch 1, the said recesses 42 in conjunction with the footing 40 provide the catch-type effect. The radius of the upwardly directed curvature of the footing 40 is dimensioned such as to allow the footing to engage into the recesses 42 without clearance.

In FIGS. 2 and 4, projections 44, 45 are indented into the upper and the lower edge of the base member 5 which, according to FIG. 2, abut on the bottom side of the circuit plate 7, whereby the base member 5 is biassed and is spaced a defined amount from the circuit plate 7 in this area.

In FIGS. 1 and 5, a pocket 46 square in cross-section and encompassed by a rim 47 is shaped on the bottom side 41 opposite to the shoulders 43 at the switch wheel 4. According to FIG. 1, the said pocket 46 contains a contact bridge 48, the bottom plate 49 of which is conformed to the pocket 46 and is loosely inserted into the pocket 46. Extending from the bottom plate 49 downwardly according to FIG. 1 are two contact lugs 50, 51 which are resilient and disposed side by side and which abut with bias on the surface 8 of the circuit plate 7. Said contact lugs 50, 51 establish the current connection between various paths of current on the circuit plate 7 so that circuits 7A are supplied with current or are disconnected therefrom.

FIG. 3 displays instead of the bayonet-type engagement illustrated in FIG. 1 a snap-in engagement 52 between the base member 5 and the switch wheel 4. The pin 17 is slotted at its free end in order to allow the webs 53, 54 formed thereby to be resiliently pressed radially inwardly when the pin 17 is urged into the circular bore designed in the base member 5. As soon as the detents 56, 57 shaped at the webs 53, 54 have penetrated the bore 55 downwardly in the drawing, the webs 53, 54 will re-assume their initial position so that the detents 56, 57 engage behind the base member 5 from underneath. This accomplishes in a simple manner a positive connection between the switch wheel 4 and the base member 5.

The assembly of the rotary switch 1 is as follows:

During the assembly of the rotary switch, the switch wheel 4 is held such that the bottom side 41 shows upwardly, as is illustrated in FIG. 5. Now the contact bridge 48 is inserted into the pocket 46, as is displayed in FIG. 1. Subsequently, the circuit plate 7 is mounted on the switch wheel 4, the pin 17 penetrating the through-bore 18. Afterwards, the base member 5 with its bore 27 is put on the section 21. Attention must be paid that the sheet-metal lug 30 engages into the slot 31 and the tab 32 into the bore 33. The base member 5 is slid onto the pin 17 as far as until the bore 27 has reached the height of the annular groove 20. Subsequently, the switch wheel 4 is turned and the section 21 now extends beyond the lateral surfaces 25, 26. The assembly of the rotary switch 1 is completed.

The base member 5 is biased by means of the annular groove 20 such that the shorter leg 40 and the contact lugs 50, 51 are abutting with bias on the switch wheel 4 and on the surface 8 of the circuit plate 7, respectively. When the circuit plate 7 is afterwards fitted together with the rotary switch 1 into the housing 2, attention should be paid that the stop 16 engages between the two stops 14, 15. This limits the angle of rotation of the rotary switch 1 so that, on the one hand, the base member 5 can never be detached from the pin 17 and, on the other hand, only those switch positions determined for the rotary switch 1 can be adjusted. Owing to the comparatively great lever arm of a force, on rotation of the rotary switch 1, the tab 32 will slide comparatively easily from one recess 42 to the next one. As also the contact lugs 50, 51 are designed as resilient tabs, the said lugs are always sliding with a constant contact force on the surface 8 of the circuit plate 7, the formation of sparks being avoided thereby to a largest possible extent. The contact force of the contact lugs 50, 51 is additionally influenced by the resilient force of the base member 5.

I claim:

1. A rotary electrical switch mounted on a circuit plate, said switch comprising a unitary, elastically deformable base member on said circuit plate, said base member including a fastening portion, a spring portion and an indexing portion, switch wheel structure mounted for rotatable movement on said circuit plate, said switch wheel structure including at least one contact bridge, said contact bridge being adapted to interconnect conducting circuit paths on said circuit plate on rotary movement of the switch wheel structure, said switch wheel structure including pivot pin structure extending from said switch wheel structure and penetrating said circuit plate and being secured by said fastening portion of said base member to said circuit plate such that said spring portion of said base member resiliently presses said contact bridge against said circuit plate, said switch wheel structure further including catch-type structure for engagement with said indexing portion of said base member as a function of the rotational position of said switch wheel structure.

2. The rotary switch as claimed in claim 1 wherein said unitary base member and said pivot pin structure are secured together by positive engagement.

3. The switch as claimed in claim 2 wherein said pivot pin structure and said base member includes bayonet-type lock structure for said positive engagement.

4. The switch as claimed in claim 2 wherein said pivot pin structure and said base member have cooperating snap-in-type structure for said positive engagement.

5. A rotary electrical switch as claimed in claim 1, wherein said base member has an edge and further including tab structure having a free end at the edge of said base member, said circuit plate having an opening, said tab structure having a section penetrating said opening in said circuit plate and said free end resiliently engaged with said catch-type structure.

6. A rotary electrical switch as claimed in claim 5 wherein said catch-type structure includes recesses substantially of V-shaped configuration, and said tab structure is substantially of L-shaped design in cross-section, and includes a curved portion for engagement with said recesses of said catch-type structure.

7. A rotary electrical switch as claimed in claim 5 wherein the length of the section of said tab structure penetrating said circuit plate is dimensioned such as to bias said base member between said recesses and its attachment to said pivot pin structure.

8. A rotary electrical switch as claimed in claim 5 wherein said base member includes an edge and a sheet-metal lug at said edge of said base member opposite to said tab structure, and said circuit plate includes an indentation, said lug engages said indentation in said circuit plate.

9. A rotary electrical switch as claimed in claim 1 wherein said base member includes projections that abut said the bottom side of said circuit plate.

10. A rotary electrical switch as claimed in claim 1 wherein said base member is made of spring sheet metal 11. A rotary electrical switch as claimed in claim 1 wherein said at least one contact bridge is arranged in a recess in said switch wheel structure, said recess having a rim that confines said contact bridge with little clearance, and said circuit plate secures said contact bridge in said recess.

12. A rotary electrical switch as claimed in claim 1 wherein said switch wheel is made of plastics.

13. A rotary electrical switch as claimed in claim 1 wherein a side of said switch wheel structure remote from said circuit plate is furnished with stop structure for limiting the rotary movement of said switch wheel structure.

14. A rotary electrical switch comprising a circuit plate having a plurality of conducting circuit paths thereon, a unitary, elastically deformable base member on said circuit plate, said base member including a fastening portion, a spring portion and an indexing portion, switch wheel structure mounted for rotatable movement on said circuit plate, said switch wheel structure including at least one contact bridge, said contact bridge being adapted to interconnect said conducting circuit paths on said circuit plate on rotary movement of said switch wheel structure, said switch wheel structure including pivot structure that extends from said switch wheel structure and penetrates said circuit plate and is secured to said fastening portion of said base member such that said spring portion of said bse member resiliently presses said contact bridge against said circuit plate, said switch wheel structure further including catch-type structure for engagement with said indexing portion of said base member as a function of the rotational position of said switch wheel structure, the length of said indexing portion penetrating said circuit plate being dimensioned such as to bias said base member between said indexing portion and its attachment to said pivot structure.

15. A rotary electrical switch as claimed in claim 14 wherein said base member is a spring sheet metal member that has an edge and includes a plurality of projections that abut a bottom side of said circuit plate and a lug portion at said edge of said base member opposite said indexing portion said circuit plate having an indentation, said lug portion being engaged in said indentation in said circuit plate.

16. A rotary electrical switch comprising a circuit plate having a plurality of conducting circuit paths thereon, a unitary, elastically deformable base member on said circuit plate, said base member including a fastening portion, a spring portion and an indexing portion, switch wheel structure of plastics material mounted for rotatable movement on said circuit plate, said switch wheel structure having a recess, contact bridge structure in said recess, said contact bridge structure being confined in said recess by said circuit plate and having adapted to electrically interconnect said conducting circuit paths on said circuit plate on rotary movement of said switch wheel structure, said switch wheel structure including pivot structure extending from said switch wheel structure through said circuit plate and being secured by said fastening portion of said base member to said circuit plate such that said spring portion of said base member resiliently presses said contact bridge structure against said circuit plate, said switch wheel structure further including catch-type structure for engagement with said indexing portion of said base member as a function of the rotational position of said switch wheel structure.

17. The switch as claimed in claim 16 wherein said indexing portion includes tab structure substantially of L-shaped design in cross-section, said circuit plate having an opening said tab structure penetrating said opening in said circuit plate and resiliently engaging said catch-type structure, said catch-type structure includes recesses substantially of V-shaped configuration, and said tab structure includes a curved portion for engagement with said recesses, the length of said tab structure penetrating said circuit plate being dimensioned such as to bias said base member between said indexing portion and said fastening portion.

18. A rotary electrical switch as claimed in claim 17 wherein said base member is a spring sheet metal member that has an edge and includes a plurality of projections that abut a bottom side of said circuit plate and a lug portion at said edge of said base member opposite said tab structure, said circuit plate having an indentation, said lug portion being engaged in said indentation in said circuit plate.

* * * * *